US010329707B2

(12) United States Patent
Fulmer et al.

(10) Patent No.: US 10,329,707 B2
(45) Date of Patent: Jun. 25, 2019

(54) LAUNDRY TREATING APPLIANCE WITH PRE-FILTER BACKWASHING

(71) Applicant: Whirlpool Corporation, Benton Harbor, MI (US)

(72) Inventors: Gregory R. Fulmer, Saint Joseph, MI (US); Kaustav Ghosh, Benton Harbor, MI (US); Nicholas E. Leep, Saint Joseph, MI (US); William L. Murch, Saint Joseph, MI (US); Matthew C. Parsons, Dowagiac, MI (US); Robert J. Pinkowski, Baroda, MI (US); Nicholas E. Righetti, Findlay, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 1036 days.

(21) Appl. No.: 13/859,079

(22) Filed: Apr. 9, 2013

(65) Prior Publication Data

US 2014/0298590 A1 Oct. 9, 2014

(51) Int. Cl.

| | |
|---|---|
| ***D06F 33/02*** | (2006.01) |
| ***D06F 39/08*** | (2006.01) |
| ***D06F 39/10*** | (2006.01) |

(52) U.S. Cl.

CPC ..... *D06F 39/10* (2013.01); *D06F 39/083* (2013.01); *D06F 33/02* (2013.01)

(58) Field of Classification Search

CPC ..... D06F 39/10; D06F 39/083

See application file for complete search history.

(56) References Cited

U.S. PATENT DOCUMENTS

| | | | | |
|---|---|---|---|---|
| 3,771,949 | A * | 11/1973 | Hermes | D06P 1/613 8/492 |
| 4,165,217 | A | 8/1979 | Kitamura et al. | |
| 5,493,745 | A | 2/1996 | Hauch | |
| 5,536,395 | A * | 7/1996 | Kuennen | C02F 1/283 210/143 |
| 6,272,770 | B1 * | 8/2001 | Slutsky | D06F 25/00 34/215 |
| 6,402,962 | B1 | 6/2002 | Bruntz et al. | |
| 7,086,110 | B2 | 8/2006 | Aouad | |
| 8,108,063 | B2 | 1/2012 | Agrawal et al. | |
| 2004/0267473 | A1 * | 12/2004 | Scheper | D06F 33/02 702/100 |

(Continued)

FOREIGN PATENT DOCUMENTS

| | | |
|---|---|---|
| CN | 201473775 U | 5/2010 |
| GB | 597733 | 2/1948 |

(Continued)

OTHER PUBLICATIONS

Machine Translation JP07039683 (Feb. 10, 1995).*

(Continued)

*Primary Examiner* — Spencer E Bell
(74) *Attorney, Agent, or Firm* — McGarry Bair PC

(57) ABSTRACT

A method and apparatus for operating a laundry treating appliance comprising a treating chamber for receiving a load of laundry for treatment according to at least one cycle of operation wherein a dye containing liquid is generated in the treating chamber during the operation, the method comprising backwashing the pre-filter to remove the non-dye material from the pre-filter.

22 Claims, 6 Drawing Sheets

(56) References Cited

U.S. PATENT DOCUMENTS

| | | | | |
|---|---|---|---|---|
| 2007/0012616 | A1* | 1/2007 | Radomyselski | D06F 39/083 210/493.1 |
| 2009/0131248 | A1* | 5/2009 | Bradley | B01D 53/885 502/200 |
| 2011/0162153 | A1* | 7/2011 | Ortiz Niembro | B01D 15/00 8/142 |
| 2012/0060300 | A1* | 3/2012 | Kim | D06F 23/04 8/137 |
| 2014/0021115 | A1* | 1/2014 | Ellegaard | C02F 9/005 210/182 |

FOREIGN PATENT DOCUMENTS

| | | | |
|---|---|---|---|
| JP | 07039683 | A | 2/1995 |
| JP | 2000051576 | A | 2/2000 |
| JP | 2009232922 | A | 10/2009 |

OTHER PUBLICATIONS

DeSilva, Frank, "Activated Carbon Filtration," Jan. 2000.*
European Search Report for Corresponding EP14162045.0, dated Nov. 13, 2014.

* cited by examiner

LAUNDRY TREATING APPLIANCE WITH PRE-FILTER BACKWASHING

BACKGROUND OF THE INVENTION

Laundry treating appliances, such as clothes washers, typically include a tub in which is mounted a rotatable wash basket for treating laundry articles according to a treating cycle of operation. The laundry articles may include dyed fabric articles. Depending on a variety of factors, the dye may loosen from a dyed article and become mixed with the wash liquid, along with non-dye materials such as lint. It is known to use a dye filter to capture the dye from the wash liquid to minimize contamination of laundry articles by the dye in the liquid. However, non-dye materials inhibit the efficacy of dye filters.

BRIEF DESCRIPTION

A method for operating a laundry treating appliance having a treating chamber for receiving a load of laundry for treatment includes performing a cycle of operation on the load of laundry wherein a dye-containing liquid is generated in the treating chamber, pumping the dye-containing liquid from the treating chamber through an upstream end of a pre-filter to remove non-dye material from the dye-containing liquid and from a downstream end of the pre-filter to a dye filter to remove dye from the dye containing liquid, and backwashing the pre-filter to remove the non-dye material from the pre-filter.

DETAILED DESCRIPTION

Figure 1:
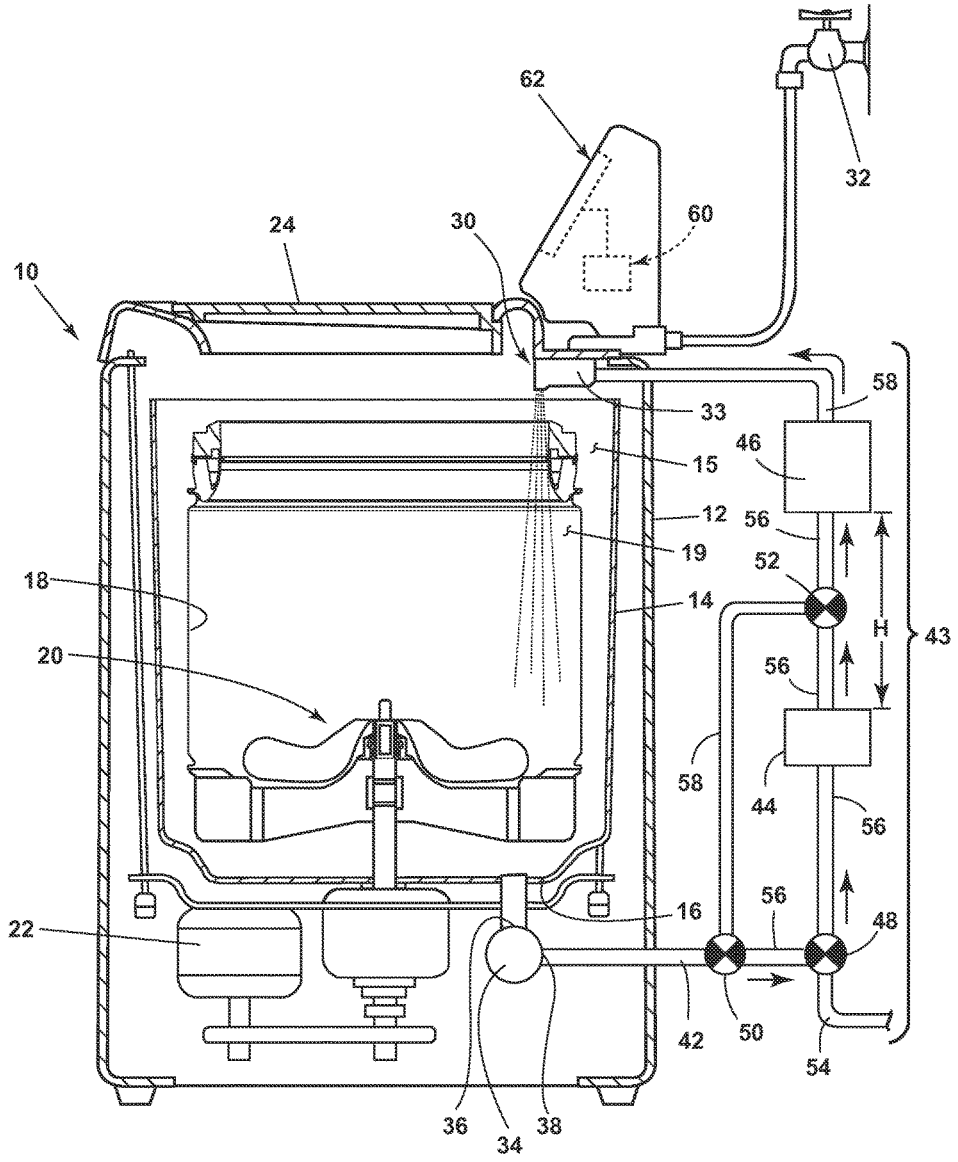
FIG. 1 is a schematic cross-sectional view of a laundry treating appliance having a dye filter system, according to a first embodiment of the invention, illustrating the dye filter system is under a dye filtering step.

Referring now to the figures, FIG. 1 is a schematic view of an exemplary laundry treating appliance 10 in the form of a washing machine having a dye filter system, according to a first embodiment of the invention. While the laundry treating appliance 10 is illustrated as a vertical axis, top-fill washing machine, the invention may have applicability in other laundry treating appliances, such as a horizontal axis washing machine, combination laundry treating appliance and dryer, an extractor, a non-aqueous laundry treating appliance, and a tumbling or stationary refreshing/revitalizing machine, for example.

The washing machine 10 may include a cabinet or housing 12 and an imperforate tub 14 that defines an interior 15 of the washing machine 10. A sump 16 may be in fluid communication with the interior 15 of the tub 14. A drum or perforated wash basket 18 may be located within and rotatable relative to the interior 15 of the tub 14 and may define a laundry treating chamber 19 in the form of a deep fill chamber for receiving a laundry load. The wash basket 18 may include a plurality of perforations or apertures (not shown) such that liquid supplied to the wash basket 18 may flow through the perforations to the tub 14. An agitator or clothes mover 20 may be located within the laundry treating chamber 19 and rotatable relative to and/or with the wash basket 18.

The wash basket 18 and/or the clothes mover 20 may be driven by an electrical motor 22, which may or may not include a gear case, operably connected to the wash basket 18 and/or the clothes mover 20. The clothes mover 20 may be commonly oscillated or rotated about its axis of rotation during a cycle of operation in order to provide movement to the fabric load contained within the laundry treating chamber 19. The wash basket 18 may be rotated at high speed to centrifugally extract liquid from the fabric load and to discharge it from the wash basket 18. The top of the housing 12 may include a selectively openable lid 24 to provide access into the laundry treating chamber 19 through the open top of the wash basket 18.

Still referring to FIG. 1, a spraying system 30 may be provided to spray liquid, such as water or a combination of water and one or more treating agents into the open top of the wash basket 18 and onto laundry placed within the laundry treating chamber 19. Non-limiting examples of treating chemistries that may be dispensed by the dispensing system during a cycle of operation include one or more of the following: water, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The spraying system 30 may be configured to supply water directly from a household water supply 32 and/or from the tub 14 and spray it onto the laundry through a sprayer 33. The spraying system 30 may also be configured to recirculate liquid from the tub 14, including the sump 16, and spray it onto the laundry. The spraying system 30 can also include additional sprayers and other components to supply liquid to one or more additional locations, such as a portion of the interior 15 between the wash basket 18 and the tub 14, an exterior surface of the wash basket 18, an interior surface of the wash basket 18 and an internal surface of the tub 14. The nature of the spraying system is not germane to the invention, and thus any suitable spraying system may be used with the laundry treating appliance 10.

A pump 34 may be housed below the tub 14. The pump 34 may have an inlet 36 fluidly coupled to the sump 16 and an outlet 38 configured to fluidly couple to a recirculation conduit 42. In this configuration, the pump 34 may be used to drain or recirculate liquid in the sump 16, which is initially sprayed into the wash basket 18, flows through the wash basket 18, and then into the sump 16. It is understood that the pump 34 may be configured to switch the pumping direction by operating the motor coupled to the pump 34 in the reverse direction. It is also understood that the location and number of the pump 34 are not limited. Instead, one or more pumps may be located anywhere in the laundry treating appliance 10 as long as the pump is provided with the liquid via any conduit.

Alternatively, two separate pumps, such as a recirculation pump and a drain pump, may be used instead of the single pump as previously described, in which case, at least one of the recirculation pump or the drain pump may be fluidly coupled to a drain conduit for flushing the liquid out of the laundry treating appliance 10 according to a treating cycle of operation. It is understood that the recirculation pump, similar to the pump 34, may be configured to switch the pumping direction by operating the motor in the reverse direction.

A dye filter system 43 may be provided for removing dye from the dye-containing liquid. The dye filter system 43 may include a pre-filter 44, a dye filter 46, a plurality of valves 48, 50, 52, and a drain conduit 54. The dye filter system 43 also includes a plurality of conduits 42, 56, 58, which are fluidly coupled to at least one of the pre-filter 44, dye filter 46 and valves 48, 50, 52, for selectively passing the liquid received from the sump 16. It may be understood that the dye filter system 43 is illustrated as positioned exteriorly of the housing 12 of the washing machine 10; in another embodiment, the dye filter system 43 may be housed in the interior of the housing 12.

The pre-filter 44 may be positioned between the pump 34 and the dye filter 46 for removing any non-dye material in the liquid before the liquid flows to the dye filter. The pre-filter 44 may comprise a mesh screen, with an opening size of the mesh screen typically ranging from 25 to 500 microns. The dye filter 46 may be configured to fluidly couple the pre-filter 44 to the sprayer 33 for removing dye from the liquid. In the illustrated embodiment the dye filter 46 may be positioned above the pre-filter 44, but it will be understood that a vertical orientation is not required for the invention. Non-limiting examples of the dye filter 46 include activated carbon, Nylon Beads, Poly(vinylpyridine), clay, ground corn cob, and treated cellulose. It is also understood that the height H of conduit between the pre-filter 44 and the dye filter 46 in the illustrated embodiment may be adjusted as necessary.

The first, second and third valves 48, 50, 52 are provided to the dye filter system 43 to control the flow direction of liquid. The valves 48, 50, 52 may be in the form of diverter valves, such that the flow of liquid may be controllably diverted. Alternatively, the valves 48, 50, 52 may be any valves that may reverse the liquid flow through the valve.

The first valve 48 may be positioned between the pump 34 and the upstream end of pre-filter 44 for controlling the flow either to the pre-filter 44 or to the drain conduit 54. The second valve 50 may be positioned between the pump 34 and the first valve 48 for controllably diverting the liquid either to the recirculation conduit 56 or a bypass conduit 58. The third valve 52 may be positioned between the downstream end of the pre-filter 44 and the upstream end of the dye filter 46. The third valve 52 may divert the liquid to the upstream end of the dye filter 46 either from the bypass conduit 58 or from the downstream end of the pre-filter 44.

As used herein, the term liquid typically includes a combination of water and one or more treating chemistries or treating agent capable of treating laundry according to a cycle of operation. The term liquid may also include water supplied from the household water supply 32 that has not been mixed with a treating agent prior to being applied to the laundry.

One or more sensors may be provided to the washing machine 10 to control the flow of liquid through the washing machine 10. Non-limiting examples of the sensors include flow rate sensor, chemical sensor, water level sensor, temperature sensor, and the like.

The washing machine 10 also includes a control system for controlling the operation of the washing machine 10 to implement one or more treating cycles of operation. The control system may include a controller 60 located within the cabinet 12 and a user interface 62 that is operably coupled with the controller 60. The user interface 62 may include one or more knobs, dials, switches, displays, touch screens and the like for communicating with the user, such as to receive input and provide output. The user may enter different types of information including, without limitation, cycle selection and cycle parameters, such as cycle options.

The controller 60 may include the machine controller and any additional controllers provided for controlling any of the components of the washing machine 10. For example, the controller 60 may include the machine controller and a motor controller. Many known types of controllers may be used for the controller 60. The specific type of controller is not germane to the invention. It is contemplated that the controller 60 is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
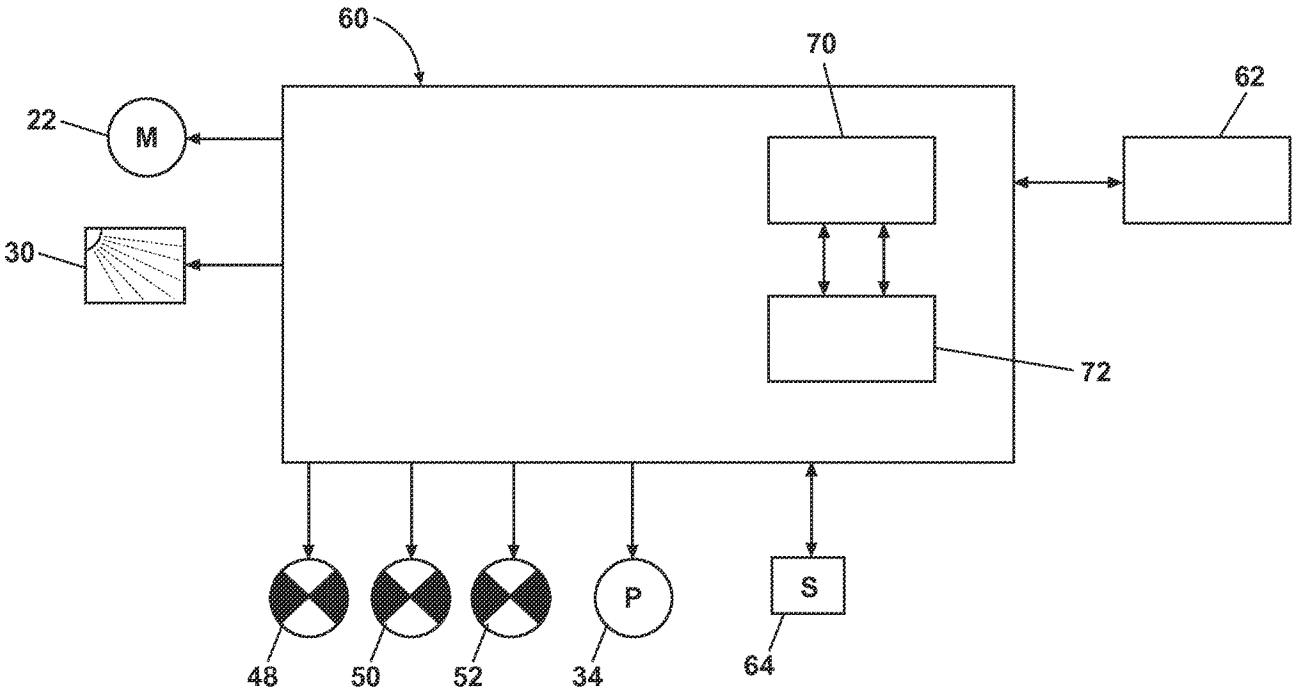
FIG. 2 is a schematic view of a controller of the laundry treating appliance of FIG. 1.

As illustrated in FIG. 2, the controller 60 may be provided with a memory 70 and a central processing unit (CPU) 72. The memory 70 may be used for storing the control software that is executed by the CPU 72 in implementing a cycle of operation using the washing machine 10 and any additional software. Examples, without limitation, of cycles of operation include: wash, heavy duty wash, delicate wash, quick wash, pre-wash, refresh, rinse only, and timed wash. A common wash cycle includes a wash phase, a rinse phase, and a spin extraction phase. Other phases for cycles of operation include, but are not limited to, intermediate extraction phases, such as between the wash and rinse phases, and a pre-wash phase preceding the wash phase, and some cycles of operation include only a select one or more of these exemplary phases.

The memory 70 may also be used to store information, such as a database or table, and to store data received from one or more components of the washing machine 10 that may be communicably coupled with the controller 60. The database or table may be used to store the various operating parameters for the one or more treating cycles of operation, including factory default values for the operating parameters and any adjustments to them by the control system or by user input.

The controller 60 may be operably coupled with one or more components of the washing machine 10 for communicating with and controlling the operation of the component to complete a cycle of operation. For example, the controller 60 may be operably coupled with the motor 22, the pump 34, and the spraying system 30 to control the operation of these and other components to implement one or more of the cycles of operation.

The controller 60 may also be coupled with one or more sensors 64 provided in one or more of the systems of the washing machine to receive input from the sensors 64, which are known in the art and not shown for simplicity.

Non-limiting examples of sensors 64 that may be communicably coupled with the controller 60 include: a flow rate sensor, a chemical sensor, a temperature sensor, a moisture sensor, a weight sensor, a position sensor and a motor torque sensor, which may be used to determine a variety of laundry treating appliance system and laundry characteristics.

The controller 60 may further be operably coupled with the valves 48, 50, 52 for controlling the flow direction of the liquid for operating the dye filter system 43. In one example, the controller 60 may control the flow direction of the liquid based on the information communicably received from one or more sensors 64.

The controller 60 is used to implement a treating cycle of operation, wherein the treating cycle of operation may include a wash phase in which a liquid, e.g., water or a mixture of water and one or more treating chemistries, is applied to the laundry, a rinse phase in which the liquid is removed from the laundry by rinsing the laundry with rinse liquid, and a spin extraction phase in which at least a portion of the rinse liquid is extracted from the laundry by spinning the laundry at high speeds.

The laundry article may comprise dyed fabric, and the dye in the fabric may not be permanently coupled to the fabric. Instead, depending on factors such as the parameters of a treating cycle of operation, the nature of the dye, or the nature of the fabric, dye may be loosened from the fabric, and released to be free in the liquid. The dye, once in the liquid, may move freely in the liquid, and may adhere to or be adsorbed by laundry articles comprising fabrics where such contamination is unwanted. As a result, when a treating cycle of operation is complete, the laundry may have undesirable effects caused by dyes. To prevent the contamination of laundry articles by dye in the liquid, the dye may be captured by the dye filter 46 while the liquid is recirculated through the laundry treating appliance.

While the liquid includes dye that may need to be removed to minimize cross contamination of laundry, it is also understood that the liquid may also include non-dye material. Non-dye material may refer to an impurity material that is physically and/or chemically coupled to the laundry articles, and may be larger in size than chemical dye. For example, a piece of paper towel or paper tissue may be received in the pocket of a pair of pants prior to being subject to a cycle of operation in the liquid. In another example, small pieces of food may also be stuck to the laundry for a treating cycle of operation. In yet another example, lint material may be released from the laundry articles, and then mixed with the liquid.

During the recirculation of liquid in a treating cycle of operation, the liquid may be supplied from the sump 16 to the sprayer 33 by way of the dye filter system 43, as illustrated in FIG. 1. The liquid is first pumped from the sump 16, passes through the pre-filter 44 and the dye filter 46, respectively, and then supplied back to the laundry treating chamber 19 via the sprayer 33. It may be understood that the flow path of liquid during the dye filtering step is set to be identical to the one during liquid recirculation. That said, when the liquid is recirculated during a cycle of operation, the dye in the liquid is also filtered in the dye filtering step.

For the dye filtering step, the second valve 50 may be set to a second position to pass the liquid from the pump 34 to the first valve 48. The first valve 48 may be set to a second position such that the liquid may be supplied from the second valve 50 to the upstream end of the pre-filter 44.

When the liquid passes through the pre-filter 44, the non-dye material may be filtered by the pre-filter 44. A portion of the non-dye material may be simply blocked from passing the pre-filter 44, and may stay in the liquid. Over time non-dye material may begin to build-up at the upstream end of the pre-filter 44. In one example, the amount of non-dye material build-up in the pre-filter 44 may be proportional to the operation time of the washing machine 10. For example, the longer the washing machine 10 operates, the greater will be the amount of non-dye material captured by the pre-filter 44. With further increase in the operation time of the washing machine 10, the non-dye material may be further pushed by the pressure exerted by the liquid during the recirculation, and eventually captured toward the interior of the pre-filter 44, away from the surface of the pre-filter 44. The build-up of the non-dye material may at least partially block the openings of the pre-filter 44, and correspondingly impede the flow of liquid through the pre-filter 44. As a result, the liquid passing through the pre-filter 44 downstream may be at a reduced flow rate and/or reduced pressure, compared to the liquid at the upstream end of the pre-filter 44.

The third valve 52 may be set to a second position to pass the liquid from the downstream end of the pre-filter 44 to the upstream end of the dye filter 46. The dye in the liquid may be removed by the dye filter 46, and the liquid, now free from dye, may be supplied to the sprayer 33 to provide a liquid spray to the laundry articles in the laundry treating chamber 19.

Figure 3:
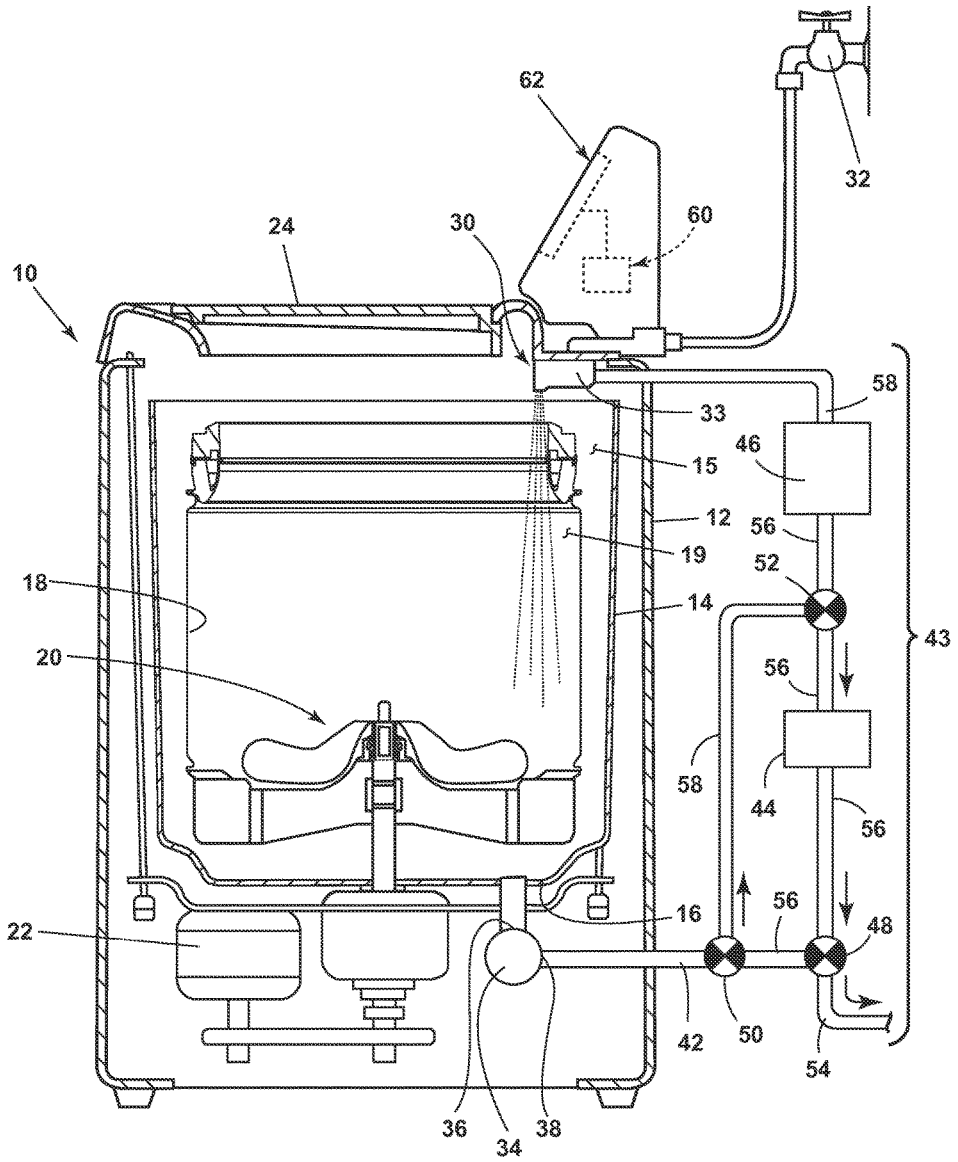
FIG. 3 is a schematic cross-sectional view of the laundry treating appliance of FIG. 1 having the dye filter system, according to the first embodiment of the invention, illustrating the dye filter system under a backwashing step.

Referring to FIG. 3, the laundry treating appliance with the dye filter system 43 in a backwashing step is illustrated, where the pre-filter 44 is backwashed by diverting liquid to the pre-filter 44 to remove non-dye material that has built up in the pre-filter 44.

The backwashing step may be performed when it is determined that the pre-filter 44 is blocked from passing the liquid. The blockage of the pre-filter 44 may be determined by monitoring the operating conditions of the washing machine 10. For example, during a treating cycle of operation, if the flow rate sensor determines that the flow rate of the liquid passing through the dye filter 46 is below a threshold, it may be determined that the pre-filter 44 is clogged by the build-up of non-dye material, and the controller 60 may perform the backwashing step.

Alternatively, the backwashing step may be determined based on the performance of the dye filter 46. In one example, when there is a decrease in the adhesion force between dye and dye filter 46 below a threshold, as determined by the chemical sensor, the pre-filter 44 may include a blockage in the pre-filter 44, and the controller 60 may begin a backwashing step to increase the liquid flow to the dye filter 46 and decrease the adhesion force between dye and the dye filter.

Alternatively, the backwashing step may be incorporated into a treating cycle of operation for the washing machine 10, such as at least one of prior to, during, and after the cycle of operation, independent of information from sensor indicating that the pre-filter 44 is blocked. For example, the backwashing step may be performed every time after a cycle of operation is complete or prior to a cycle of operation.

The backwashing step may be conducted by diverting the liquid to the downstream end of the pre-filter 44. For this, the second valve 50 may be set to a first position to direct the liquid from the sump 16 to the third 52. The third valve 52 may be set to a first position for directing the liquid from the second valve 50 to the downstream end of the pre-filter 44. When the pre-filter 44 is provided with the liquid from the downstream end, the liquid may transfer kinetic energy to the non-dye material collected to the pre-filter 44 toward the upstream end of the pre-filter 44. As a result, the non-dye material may be removed from the pre-filter 44.

During the backwashing step, the first valve 48 may be set to a first position to direct the liquid, which now includes non-dye material decoupled from the pre-filter 44, to the drain conduit 54. After the backwashing step, additional water may be optionally supplied from a household water supply 32 into the treating chamber 19 for making up the liquid drained during the backwashing step.

Figure 4:
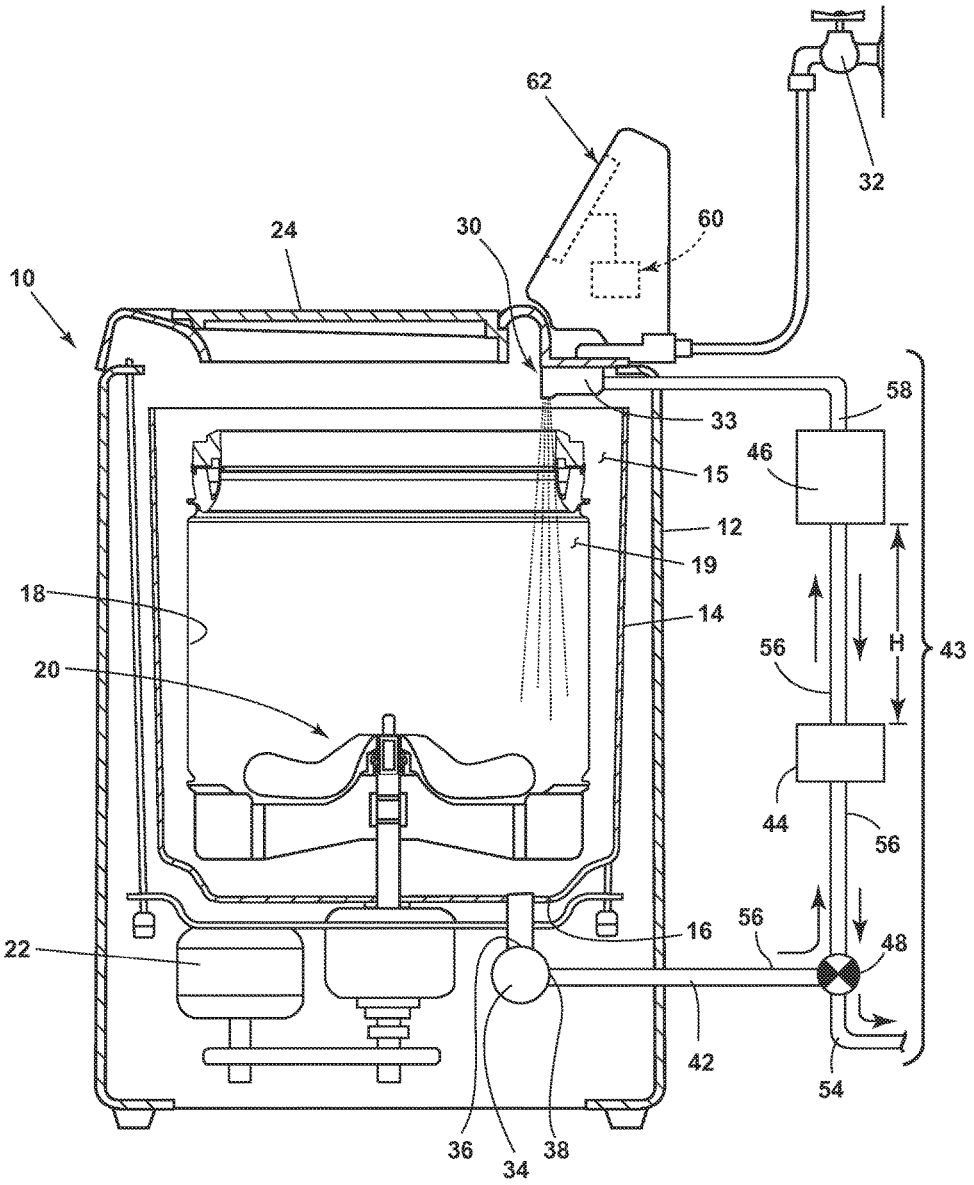
FIG. 4 is a schematic cross-sectional view of the laundry treating appliance according to a second embodiment of the invention, illustrating the flow of liquid reversed by gravity.

Referring to FIG. 4, a second embodiment for backwashing the pre-filter 44 is illustrated, where the flow direction of liquid is reversed by gravity for backwashing the pre-filter 44. As illustrated, the backwashing of the pre-filter 44 by gravity may not need the second and third valves, 50, 52, as well as the bypass conduit 58, compared to the first embodiment illustrated in FIG. 3.

During the dye filtering step, the liquid in the sump may be continuously circulated through in the order of the pump 34, the pre-filter 44, and then the dye filter 46, for continuously removing the dye in the liquid, as previously described for FIG. 1. When it is determined that backwashing step may be necessary, the pump 34 may be turned off by the controller 60. Once the pump 34 is turned off, the liquid upwardly passing the conduit 56 between the pre-filter 44 and dye filter 46 may lose the driving force from the pump 34, and may not further be upwardly pumped.

Instead, the liquid may reverse the flow direction and flow downwardly by gravity to the downstream end of the pre-filter 44. Since the liquid under gravity is provided with kinetic energy that is proportional to the conduit height H between the pre-filter 44 and the dye filter 46, the liquid may transfer the kinetic energy to the non-dye material in the pre-filter 44 in a similar way to the embodiment as illustrated in FIG. 3. The first valve 48 may be set to the first position to divert the liquid with the non-dye material from the upstream end of the pre-filter 44 to the drain conduit 54.

While the liquid in the volume of conduit 56 between the pre-filter 44 and dye filter 46 may be enough for backwashing the pre-filter 44, it may be noted that a liquid container (not shown) may also be added to the dye filter system 43 for temporarily storing the liquid for offering increased amount of liquid to backwash the pre-filter 44. In one example, the liquid container may be positioned to fluidly couple the pre-filter 44 and the dye filter 46, while the liquid container may be positioned between the downstream end of dye filter 46 and the sprayer 33 in another embodiment. In another example, the liquid container may be provided with a valve such that the liquid collected in the liquid container may be controllably released to the downstream end of the pre-filter 44 during the backwashing step.

Figure 5:
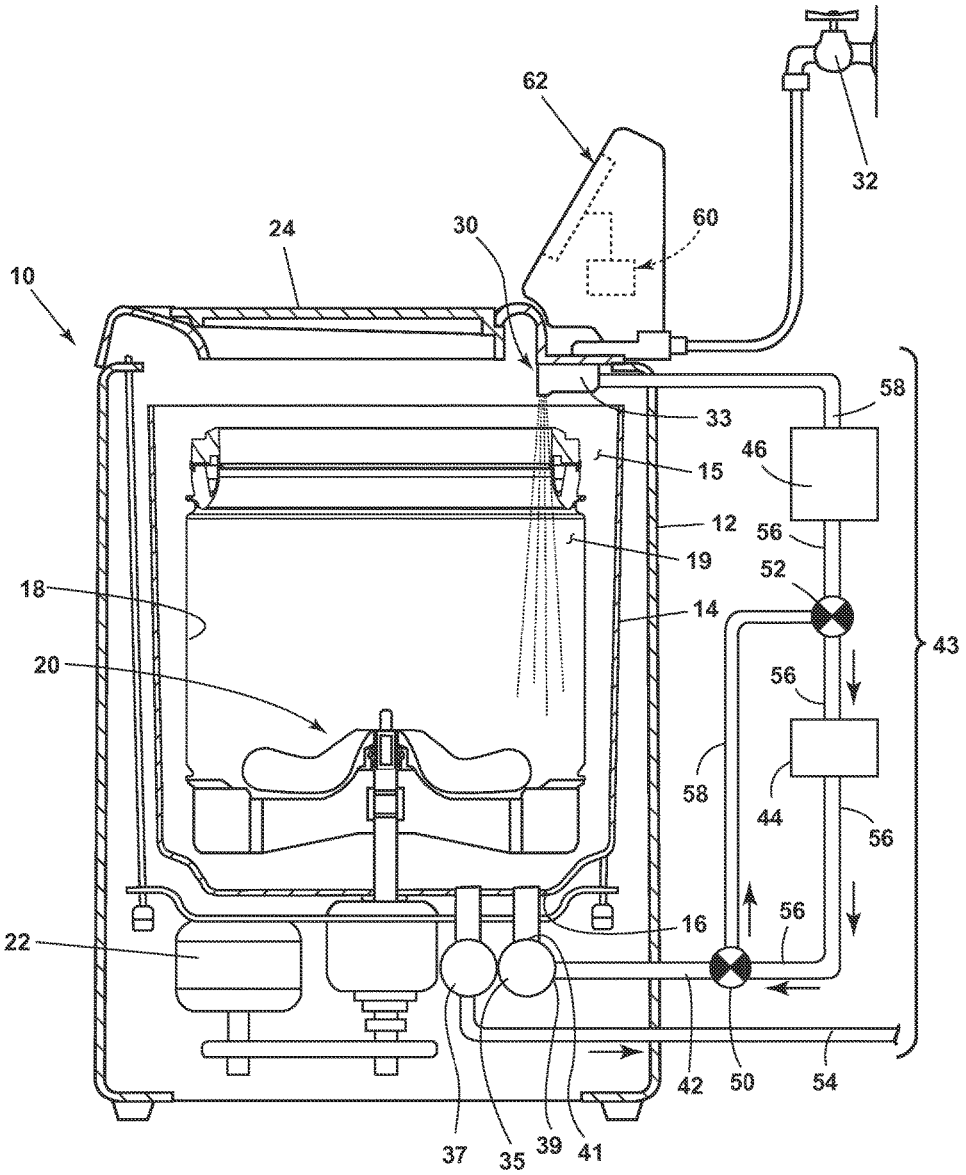
FIG. 5 is a schematic cross-sectional view of the laundry treating appliance according to a third embodiment of the invention, illustrating the backwashing step using both a recirculation pump and a drain pump.
Figure 6:
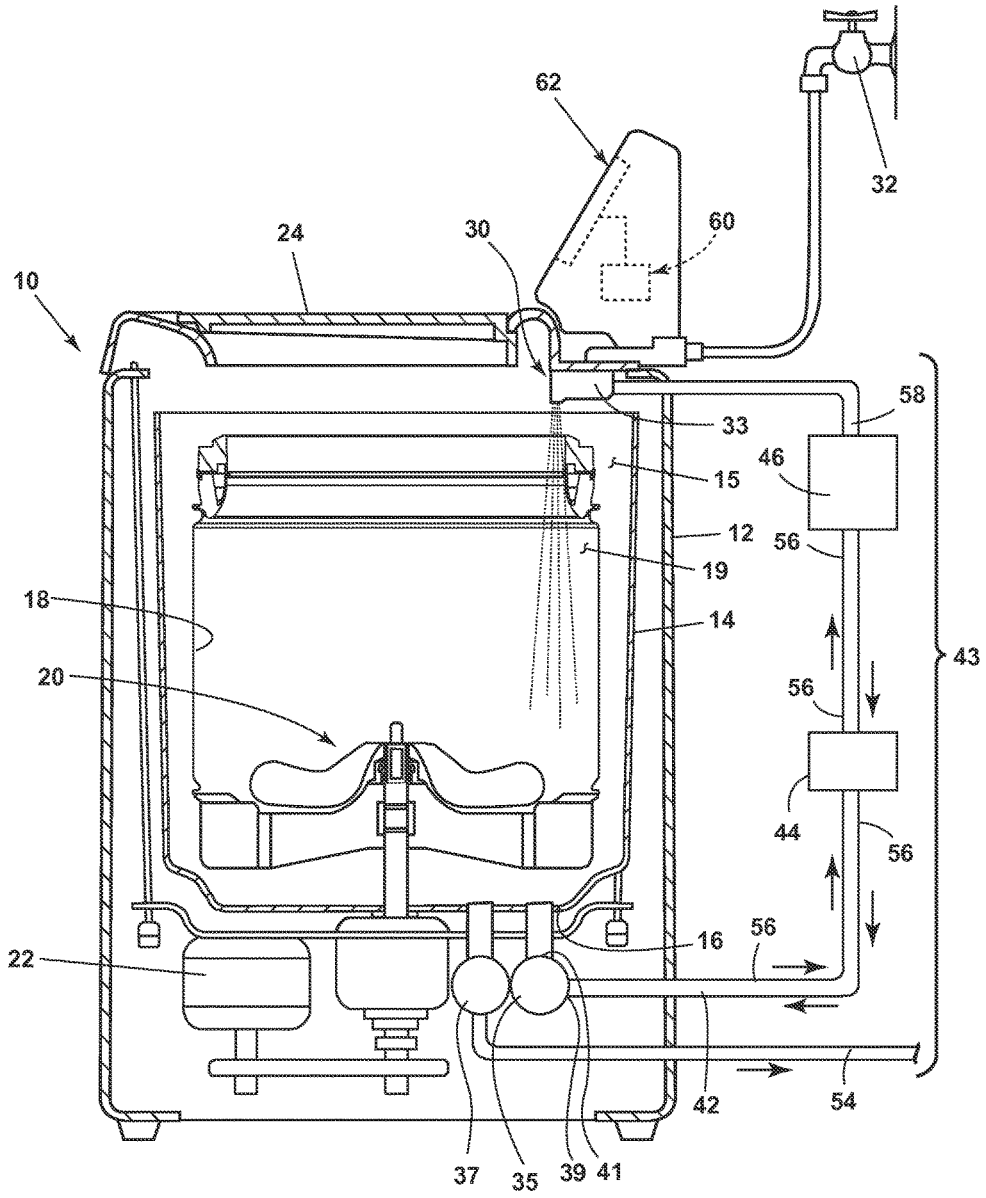
FIG. 6 is a schematic cross-sectional view of the laundry treating appliance according to a fourth embodiment of the invention, illustrating the backwashing step without any valves.

Regarding FIGS. 5 and 6, the backwashing step in the laundry treating appliance having both a recirculation pump and a drain pump is illustrated, according to third and fourth embodiments of the invention, respectively. In FIG. 5, the liquid, which is provided from the sump 16, may be directed to the downstream end of the pre-filter 44 through the second valve 50 and third valve 52, then pass through the pre-filter 44, as previously described for backwash in the embodiment illustrated in FIG. 3. After a predetermined time period, the recirculation pump 35 may reverse the pumping direction, such that the liquid in the dye filter system 43 flows back to the sump 16 by passing through the second valve 50 set to a third position to pass the liquid from the upstream end of the pre-filter 44 to the recirculation pump 35, and an inlet and outlet 39, 41 of the recirculation pump 35. It may be understood that the inlet and outlet 39, 41 are coupled to the reversely operable recirculation pump 35, therefore the inlet and outlet 39, 41 may work as outlet and inlet in another mode of operation. The liquid collected in the sump 16 may be provided to a drain pump 37 to be flushed out of the washing machine 10 via the drain conduit 54. Alternatively, first valve 48 may be provided in the recirculation conduit 56 between the pre-filter 44 and the second valve 50 to direct backwash liquid from the pre-filter through a separate conduit (not shown) to the sump 16, in which case the recirculation pump 35 need not be reversed and the second valve 50 need not be set to third position.

While FIG. 5 illustrates the backwashing step using both the recirculation pump 35 and the drain pump 37. In another embodiment, the single pump may be used instead of the recirculation pump 35 and the drain pump 37. The single pump may be provided with the recirculation conduit 42 and the drain conduit 54 such that the liquid may not need to flow back into the sump 16 before being drained out of the washing machine 10. For example, after the liquid is diverted to the downstream end of the pre-filter 44 and downwardly passed through the pre-filter 44, the liquid may be directed back to the single pump, to which the drain conduit may be fluidly coupled. The liquid may be diverted from the single pump to the drain conduit without being routed to the sump 16.

FIG. 6 illustrates the backwashing step of the laundry treating appliance, where the backwashing step is performed without any valves. The operation of the backwashing step may be similar to the second embodiment illustrated in FIG. 4, in that the backwashing step of the pre-filter 44 is performed using the reversed flow of liquid by gravity. The difference between the embodiments in FIG. 4 and FIG. 6 is that the embodiment in FIG. 6 may be implemented without using any valve.

During the backwashing step, as illustrated in the embodiment of FIG. 4, when the recirculation pump 35 is turned off, the liquid flowing upwardly in the conduit 56 between the pre-filter 44 and the dye filter 46 may flow downwardly by gravity. Due to the absence of any valve in the conduit 56, the liquid may be collected to the lower portion of the conduit 56, and then directed to the sump 16 by the reverse operation of the recirculation pump 35. The liquid collected in the sump 16 may be provided to the drain pump 37 to be flushed out of the washing machine 10 via the drain conduit 54.

As described above for FIG. 5, it may be noted that the single pump may be used in replace of the recirculation pump 35 and drain pump 37 to route the liquid directly from the single pump to the drain conduit, without entering into the sump 16. Further, it may be that the recirculation pump 35 is positioned such that gravity will direct a backflow of liquid to the sump 16 without action of the pump.

The invention described herein may be used in removing non-dye material from the pre-filter during the dye filtering step, before the pre-filter blocks the passage of liquid through the pre-filter. Non-dye material, which is collected by the pre-filter during the dye filtering step, may be removed from the pre-filter by backwashing the pre-filter by controllably directing the liquid to the downstream end of the pre-filter. Alternatively, the pre-filter may be backwashed by reversing the flow of liquid to the downstream end of the pre-filter by gravity.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating an aqueous-based laundry treating appliance comprising a treating chamber for receiving a load of laundry for treatment according to at least one cycle of operation, the method comprising:

performing the at least one cycle of operation on the load of laundry wherein an aqueous-based dye-containing liquid is generated in the treating chamber;

pumping the aqueous-based dye-containing liquid from the treating chamber through an upstream end of a pre-filter to remove non-dye material from the aqueous-based dye-containing liquid and then from a downstream end of the pre-filter through a valve to a dye filter to remove dye from the aqueous-based dye-containing liquid; and backwashing the pre-filter to remove the non-dye material from the pre-filter by diverting liquid from the treating chamber to the downstream end of the pre-filter;

wherein the diverting step comprises enabling flow of liquid from the upstream end of the pre-filter to a drain, and directing flow from the treating chamber to the downstream end of the pre-filter and to the upstream end to the drain, and wherein the flow does not traverse the dye filter; and wherein the diverting step occurs upon determining there is a decrease in the adhesion force between the dye from the aqueous-based dye-containing liquid and the dye filter.

2. The method of claim 1 wherein the determining there is a decrease in the adhesion force step further comprises monitoring a chemical sensor.

3. The method of claim 1, wherein the diverting step comprises setting a first valve to a first position enabling flow of liquid from the upstream end of the pre-filter to a drain, setting a second valve between the pump and the first valve to a first position directing flow to a third valve between the downstream end of the pre-filter and the dye filter, and setting the third valve to a first position directing flow from the second valve to the downstream end of the pre-filter and to the upstream end to the drain.

4. The method of claim 1, wherein the backwashing step is performed at least one of prior to, during, and after the cycle of operation.

5. The method of claim 1, wherein the backwashing step comprises reversing the flow of liquid through the pre-filter by gravity.

6. The method of claim 5 wherein the reversing step comprises setting a first valve between the pump and the upstream end of the pre-filter to a first position, enabling the liquid to flow from the upstream end of the pre-filter to a drain.

7. The method of claim 1, further comprising draining the non-dye material filtered from the pre-filter exterior of the laundry treating appliance.

8. The method of claim 1 wherein the diverting step comprises enabling flow of a household water supply.

9. The method of claim 1 wherein the diverting step comprises enabling flow of a combination of water and a treating chemistry.

10. The method of claim 1 wherein the diverting step occurs upon determining the pre-filter is blocked from passing the liquid through the upstream end of the pre-filter.

11. The method of claim 10 wherein the determining the pre-filter is blocked step further comprises monitoring a flow rate of the liquid through the upstream end of the pre-filter.

12. The method of claim 11 wherein the determining the pre-filter is blocked step further comprises determining if the monitored flow rate of the liquid is below a flow rate threshold.

13. An aqueous-based laundry treating appliance comprising:

a treating chamber for receiving a load of laundry for treatment according to at least one cycle of operation wherein a dye-containing liquid is generated in the treating chamber during the operation, a pre-filter having an upstream end and a downstream end and located downstream from the treating chamber, having a pre-filter medium that removes non-dye material from the dye-containing liquid, a dye filter downstream from the pre-filter, having a dye filter medium that removes dye from the dye-containing liquid, means to backwash the pre-filter to remove the non-dye material from the pre-filter, the means comprising at least one valve and a drain;

a pump in fluid communication with the upstream end of the pre-filter for pumping the dye-containing liquid from the treating chamber through the upstream end of the pre-filter and through the downstream end of the pre-filter through the valve to the dye filter, and a sensor for determining if an adhesion force between the dye from the aqueous-based dye-containing liquid and the dye filter has decreased below a threshold; and a controller configured to:

determine whether there is a decrease in the adhesion force;

upon determining a decrease in the adhesion force, divert liquid from the treating chamber to the downstream end of the pre-filter, enable a flow of liquid from the upstream end of the pre-filter to the drain, and direct flow from the treating chamber to the downstream end of the pre-filter and to the upstream end to the drain, wherein the flow does not traverse the dye filter.

14. The laundry treating appliance of claim 13 wherein the pump is disposed at least between the treating chamber and the pre-filter, pre-filter and dye filter, or the dye filter and treating chamber.

15. The laundry treating appliance of claim 14, wherein the pump comprises one of a circulation pump, a drain pump, or combination thereof.

16. The laundry treating appliance of claim 13, wherein the means to backwash the pre-filter comprises a first valve between the pump and an upstream end of the pre-filter and a drain, a second valve between the pump and the first valve, and a third valve between the downstream end and the dye filter in communication with the second valve, whereby when the first, second, and third valves are set to selected positions, the pump will divert liquid in a reverse flow through the pre-filter to the drain.

17. The laundry treating appliance of claim 13 wherein the means to backwash the pre-filter comprises a first valve between the pump and an upstream end of the pre-filter and a drain, wherein when the first valve is set to a selected position enabling flow of liquid from the upstream end of the pre-filter to a drain, and when the pump is inactivated, gravity will cause the liquid to move in a reverse flow through the pre-filter to the drain.

18. The laundry treating appliance of claim 13, wherein the pre-filter medium comprises a mesh screen.

19. The laundry treating appliance of claim 18, wherein the pre-filter medium has an opening size ranging from 25 to 500 microns.

20. The laundry treating appliance of claim 13, wherein the dye filter medium comprises at least one of activated carbon, Nylon Beads, Poly(vinylpyridine), clay, ground corn cob, and treated cellulose.

21. The laundry treating appliance of claim 13, wherein the dye filter is positioned above the pre-filter.

22. The laundry treating appliance of claim 13, wherein the treating chamber is a deep fill chamber.

* * * * *